US006640462B1

(12) United States Patent
Choi et al.

(10) Patent No.: US 6,640,462 B1
(45) Date of Patent: Nov. 4, 2003

(54) METHOD OF DRYING WOOD AND A SYSTEM THEREFOR

(76) Inventors: Sun Tae Choi, Bulkwang-dong 365-15, Eunpyung-gu, Seoul 122-040 (KR); Vladimir Petrovich Golitsyn, Profinterno Street 40A 18, Barnaul, 656002 (RU); Natalya Vladimirovna Golitsyna, Profinterno Street 40A 18, Barnaul, 656002 (RU); Nam Joo Huh, #706, Dong Han Kuk Apt. 103, Maetan-dong, Paldal-gu, Suwon, Kyunggi-do 442-370 (KR); Kun Pyo Kim, 101-701, Marrium Apt.., Buam 1-dong, Jin-gu, Busan, 614-091 (KR)

( * ) Notice: Subject to any disclaimer, the term of this patent is extended or adjusted under 35 U.S.C. 154(b) by 0 days.

(21) Appl. No.: 10/030,107

(22) PCT Filed: May 19, 2000

(86) PCT No.: PCT/KR00/00492

§ 371 (c)(1),
(2), (4) Date: May 30, 2002

(87) PCT Pub. No.: WO01/88449

PCT Pub. Date: Nov. 22, 2001

(51) Int. Cl.[7] ..... F26B 7/00; F26B 21/06

(52) U.S. Cl. ..... 34/406; 34/396; 34/402; 34/403; 34/407; 34/408; 34/559

(58) Field of Search ..... 34/406, 407, 408, 34/412, 396, 558, 559, 402, 403, 218

(56) References Cited

U.S. PATENT DOCUMENTS 1,328,658 A * 1/1920 Fish ..... 34/350
1,778,079 A * 10/1930 Kristensson ..... 34/403
2,557,621 A * 6/1951 Touborg ..... 34/15

(List continued on next page.)

FOREIGN PATENT DOCUMENTS

KR 9624197 B 7/1996

OTHER PUBLICATIONS

English Labguage Abstract of KR96–24197.

*Primary Examiner*—Ira S. Lazarus
*Assistant Examiner*—K. B. Rinehart
(74) *Attorney, Agent, or Firm*—Greenblum & Bernstein, P.L.C.

(57) ABSTRACT

Disclosed is a method of drying timbers loaded in a drying chamber, which comprises the steps of heating the drying chamber by a heating system up to a temperature of 80 to 100° C., subjecting the timbers to vacuum blowing by connecting the inside of the drying chamber with a vacuum chamber (receiver) evacuated by a rotary pump until the inside pressure of the drying chamber drops to 1 to 10 mmHg, disconnecting the inside of the drying chamber from the vacuum chamber, connecting the drying chamber with the atmosphere. When the inside of the drying chamber is connected with the vacuum chamber, the moisture content of the timbers is sharply reduced, so that their temperature sharply drops. Thereafter, when it is disconnected from the vacuum chamber, and connected with the atmosphere, the inside temperature of the drying chamber is again increased. Meanwhile, the heating system is worked during the whole process. The above steps constitute one cycle that is sequentially repeated until the moisture content of the timbers drops to a desired level. Preferably, the connection between the drying chamber with the vacuum chamber is made in 0.1 to 0.5 seconds. Pressure release is made in the vacuum for 0.5 to 5.0 seconds until reaching equilibrium moisture. The blow-down in the vacuum is carried out by a heat carrier with a temperature of 80 to 150° C. until reaching the volume average material temperature of 80 to 90° C. with the subsequent pressure release in the drying chamber lower than the equilibrium, thus providing high-speed vacuum blowing.

19 Claims, 2 Drawing Sheets

U.S. PATENT DOCUMENTS 3,283,412 A * 11/1966 Farnsworth ..... 34/5
3,698,098 A * 10/1972 Ramsay ..... 34/15
4,026,037 A 5/1977 Buchholz
4,233,752 A * 11/1980 Kleiguenther ..... 34/9.5
4,250,628 A * 2/1981 Smith et al. ..... 34/1
4,347,671 A * 9/1982 Dias et al. ..... 34/15
4,560,346 A * 12/1985 Schulz ..... 432/24
4,893,415 A * 1/1990 Moldrup ..... 34/16.5
5,425,182 A 6/1995 Brunner
5,433,020 A * 7/1995 Leech ..... 34/403
5,505,007 A * 4/1996 Raeckers ..... 34/289
5,732,478 A * 3/1998 Chapman et al. ..... 34/629
5,819,436 A * 10/1998 Helevirta ..... 34/408
6,473,994 B1 * 11/2002 Dedieu et al. ..... 34/396

* cited by examiner

METHOD OF DRYING WOOD AND A SYSTEM THEREFOR

TECHNICAL FIELD

The invention concerns a method of drying wood in a wood-working or construction material industry, and a system therefor.

BACKGROUND ART

A conventional method of drying construction materials under vacuum generally comprises the steps of blowing down the materials by a heat carrier, subjecting them to vacuum blowing, and sequentially repeating the previous steps at multiple times. The materials are adiabatically held during each cycle between heating and vacuum blowing. The duration of the adiabatic holding equals that of the blowing down. The blowing down is performed by a steam-and-gas mixture with a temperature of 160° C. and a moisture content of 15 g/kg of the material for 6 minutes. The vacuum blowing is carried out at the residual pressure of 300 mm Hg [1].

Another conventional method of drying wood comprises the steps of subjecting the wood to a hot air blast with simultaneously removing the vapor evolved therefrom, subjecting it to vacuum blowing, and cooling it off. The wood is preliminarily held in vacuum of 10 kPa, subjected to the hot air blast at a temperature of 50 to 60° C. with simultaneously removing the evolved vapor firstly at the air rate of 2.75 under 30 kPa, and secondly at the air rate of 3.25 m/s under 20 kPa. Then, the cooling-off is carried out by air with a temperature of 4–20° C. in a vacuum of firstly 15 kPa and then 10 kPa at the air rate of 3.54 m/sec and 45 m/sec, respectively.[2]

Another conventional method of drying wood in the drying chamber comprises the steps of subjecting wood to blast of heated air with removal of the evolved vapors, subjecting it to vacuum blowing, and cooling it off in atmospheric conditions. The duration for subjecting it to the blast of heated air and the vacuum blowing amounts 45 to 120 seconds.[3]

Another conventional method of drying wood in the drying chamber is to blow down the wood by a heat carrier with removal of the evolved vapors. This method comprises the steps of heating wood up to the volume average temperature of 80 to 100° C., subjecting it to vacuum blowing, and blowing it down by a heat carrier. When the vacuum blowing is held until the pressure in the pressure-tight chamber reaches the atmosphere, the wood is dried up to 30% of the moisture content. Then, the vacuum blowing is carried out at the residual pressure of 10 to 50 mmHg for 30 to 120 minutes. After the vacuum blowing, the condensation is drained, and then, blow-down is conducted by a heat carrier with a temperature of 80 to 150° C. for the time equal to that of the vacuum blowing. Thus, the process of drying to 30% of the moisture is repeated until the total time reaches the value, defined by a ratio:

$$\tau^1 = \frac{P_{ycl} \times (W_h - 30)}{1.57 \times S_{1m3^2}^{d \cdot m} \times V \times 100}$$

Where

Pycl—conditional density of designated material, kg/m3

Wh—initial moisture of designated material, %

30—final moisture of designated material at the stage of removal of free moisture, %

1.57—amount of moisture, evolved from 1 m2 of conditional timber after 1 hr at vacuum blowing, kg/m2 h $$S_{1m3^2}^{d \cdot m}$$

Thereafter, the process of drying up to the final moisture is repeated until the total time of the vacuum blowing reaches the value defined by the following ratio:

$$\tau^2 = \frac{P_{ycl} \times (30 - W_h)}{1.57 \times S_{1m3^2}^{d \cdot m} \times V \times 100}$$

Wk—final moisture of desiccated material, % [4].

Thus, such conventional methods suffer increased consumption of the time, power, cost, etc. taken for obtaining the final product.

DISCLOSURE OF INVENTION

It is an object of the present invention to provide a method of drying wood which reduces the time, power, and cost taken for obtaining the finally dried wood product.

According to an aspect of the present invention, a method of drying timbers loaded in a drying chamber comprises the steps of heating the drying chamber by a heating system up to a temperature of 80 to 100° C., subjecting the timbers to vacuum blowing by connecting the inside of the drying chamber with a vacuum chamber (receiver) evacuated by a rotary pump until the inside pressure of the drying chamber drops to 1 to 10 mmHg, disconnecting the inside of the drying chamber from the vacuum chamber, connecting the drying chamber with the atmosphere. When the inside of the drying chamber is connected with the vacuum chamber, the moisture content of the timbers is sharply reduced, so that their temperature sharply drops. Thereafter, when it is disconnected from the vacuum chamber, and connected with the atmosphere, the inside temperature of the drying chamber is again increased. Meanwhile, the heating system is worked during the whole process. The above steps constitute one cycle that is sequentially repeated until the moisture content of the timbers drops to a desired level. Preferably, the connection between the drying chamber with the vacuum chamber is made of 0.1 to 0.5 seconds. Pressure release is made in the vacuum for 0.5 to 5.0 seconds until reaching equilibrium moisture. The blow-down in the vacuum is carried out by a heat carrier with a temperature of 80 to 150° C. until reaching the volume average material temperature of 80 to 90° C. with the subsequent pressure release in the drying chamber lower than the equilibrium, thus providing high-speed vacuum blowing.

According to another aspect of the present invention, a system of drying timbers loaded in a drying chamber comprises a heating system for heating the drying chamber up to a temperature of 80 to 100° C., a vacuum chamber connected with the inside of the drying chamber for subjecting the timbers to vacuum blowing, a vacuum pump connected with the vacuum chamber, a manifold for connecting the drying chamber with the vacuum pump, a condenser connected with the vacuum chamber for draining the condensate therein, a first automatic quick-action valve for connecting the drying chamber with the atmosphere, and a second automatic quick-action valve for connecting the condenser with the vacuum chamber. Preferably, the heating system is designed so as to blow a hot air tangentially (vertically) to the timbers. The drying chamber is divided into a plurality of zones each having a quick reacting vacuum valve to the heating system. The inside of the drying chamber is equipped with a plurality of elements for equivalently supplying the hot air along the height of the timbers.

In this case, the diameter of a connecting manifold between the drying chamber and the vacuum chamber may be calculated by the following formula:

$$d = \sqrt[4]{\frac{(P + P_0)128\eta l V_0}{P \cdot P_0 t\pi}}$$

Wherein

P—pressure in the drying chamber

Po—pressure in the vacuum chamber

η—kinetic viscosity, cSt l—length of the manifold from the drying chamber to the vacuum chamber Vo—working free volume of the drying chamber t—time of evacuating lower than the equilibrium

BEST MODE FOR CARRYING OUT THE INVENTION

Figure 1:
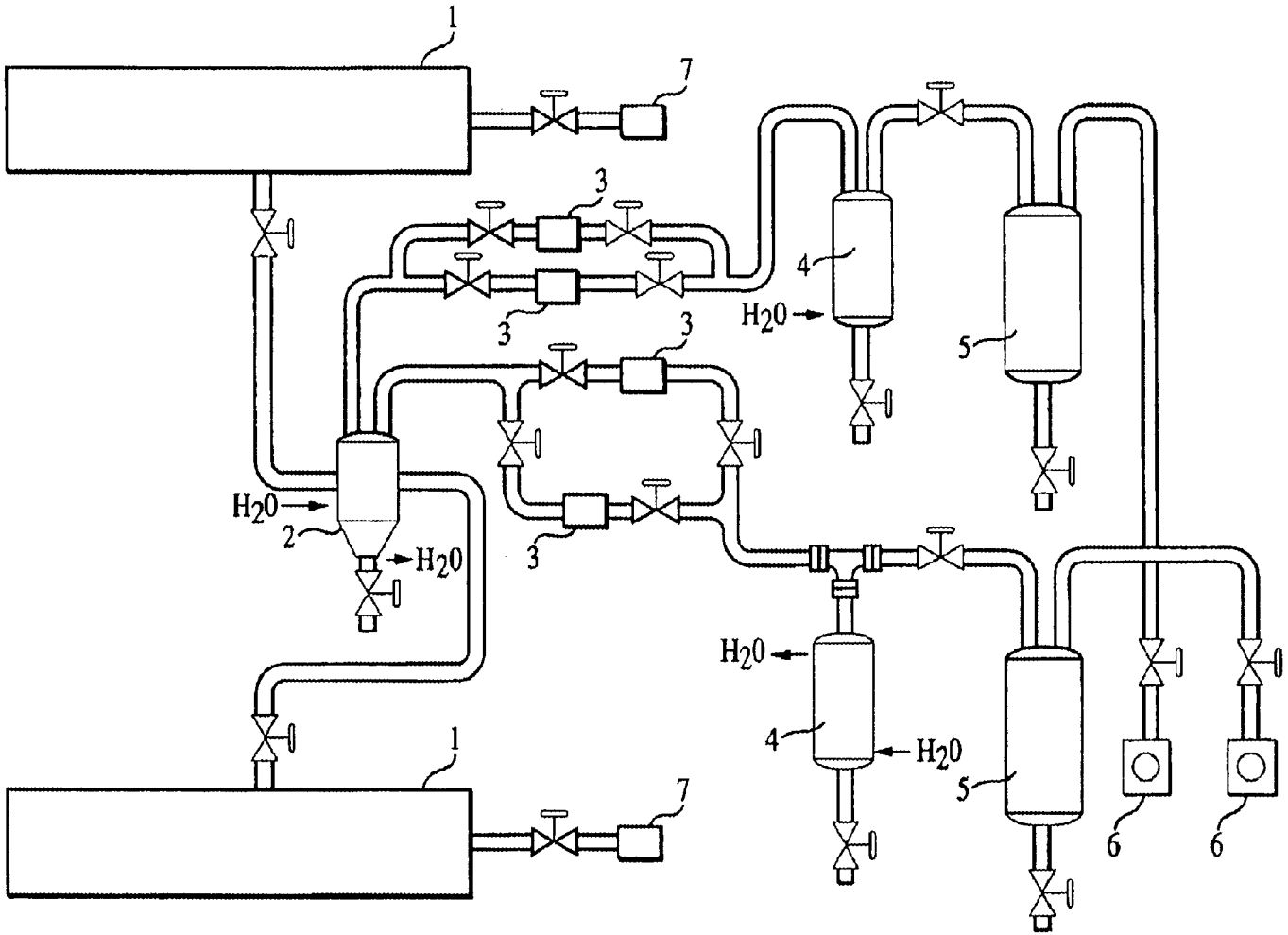
FIG. 1 is a block diagram for illustrating a system for drying wood according to the present invention.

Water contained in a wood material generally exists in two basic types: one is the free moisture type existing in the cell cavities and the capillary tubes; and the other is the bound moisture type existing in the cell walls. Accordingly, the pore size lies in the limits of 10 nm and 1 nm. The maximum amount of the bound moisture in the wood, which is approximately identical for all kinds of wood, is approximately 30% by mass at 20° C. All the remaining moisture is the free type. Drying wood, the free moisture is firstly removed, and then the bound moisture. Heating up the wood, hydroscopicity falls, transforming a part of the bound moisture transfers into the free type. According to the invention, the drying of wood is accomplished in two stages. At the first stage, the free moisture is removed from the capillary tubes and inter-capillary space at the expense of setting the pressure in the drying chamber lower than the pressure of the saturated vapors of the wood water at a specified temperature. The moisture is forced out from the capillary tubes due to the expansion of the dissolved and fastened gas. It is partially vaporized, subsequently drained from the drying chamber. At the second stage, the bound moisture is removed from the surface, evaporated from the surface. It is achieved by fast connecting the drying chamber with the vacuum chamber to decrease the pressure of the preheated wood lower than the pressure of the saturated vapors.

The process is carried out as follows:

In the beginning, the wood in the drying chamber is heated up to the volume average temperature of 80 to 100° C. It results in lowering the surface tension of water in the capillary tubes and in the inter-capillary spaces and raising the vapor pressure up to the values close to atmosphere. At the subsequent vacuum blowing, the energy is transferred to the moisture to undergo the phase change. The increase of the temperature of the wood higher than 100° C. results in the beginning of its destruction with loss of quality while the decrease of the temperature lower than 8° C. reduces the equilibrium pressure of the saturated vapors to increase the number of the cycles each comprising the steps of heating, vacuum blowing, and blowing-down, and thus the total time of the drying process. This results in the increase of the energy consumption.

After preheating the wood, the drying chamber is connected with the vacuum chamber for 0.1 to 0.5 seconds by means of a quick-acting valve to perform a pressure release in the drying chamber for 0.5 to 5.0 seconds up to the equilibrium pressure of the saturated vapors at a given temperature, and then to hold in the vacuum for some time, maintaining the minimum residual pressure in the drying chamber by the vacuum blowing. Thereafter, the evolved water vapors are removed, and condensed to drain by disconnecting the drying chamber from the vacuum blowing. The wood under the residual pressure is then heated up to the volume average temperature of 80 to 100° C., and then again, the drying chamber is connected with the vacuum chamber by the quick-acting valve. This operation cycle, which comprises the steps of heating the wood in the vacuum up to the volume average material temperature of 80 to 100° C., performing the pressure release up to the value lower than the saturated vapor pressure (355 to 760 mm Hg) at the temperature, holding it in the vacuum by connecting the drying chamber with the vacuum chamber, removing the evolved vapors, performing the condensed drain, disconnecting the drying chamber from the vacuum chamber, and heating it in the vacuum under the residual pressure up to the temperature of 80 to 90° C., is carried out many times until achieving the wood residual moisture of about 30%.

This process causes the following physical phenomena to occur. Namely, the fast setting up the pressure in the drying chamber lower than the equilibrium pressure of the saturated vapors causes the saturated vapors to be transformed into the state of the superheated vapor, so that the water vapors in the capillary tubes of the wood is sharply evaporated, exhausted into the drying chamber space. The intense vaporization from the surface results in cooling-off the water in the wood lower than its boiling temperature at a given pressure. Because of the low thermal conductivity of the wood, it has no time to be in the temperature lower than its boiling temperature throughout all volume, so that the vapors formed inside the capillary tubes are exhausted from them. Further release of water from the capillary tubes is achieved by the partial vaporization. The fast setting up the pressure in the drying chamber lower than the equilibrium pressure results in sharp expansion of the fastened gases and dissolved gases in the capillary water, so that the water in the capillary tubes is ejected from the drying chamber.

The time of 0.1 to 0.5 seconds for setting up the residual pressure provides an optimal course of the process while the time for connecting the drying chamber with the vacuum chamber amounts to 0.1 to 0.5 seconds. The reduction of the time for connecting the drying chamber with the vacuum chamber less than 0.1 seconds results in complication of a construction of shut-off accessories. In addition, the reduction of the time for setting up the residual pressure less than 0.1 second results in complication of the apparatus implementation. Therefore such time reduction is undesirable. On the contrary, the increase of the time for connecting the drying chamber with the vacuum chamber more than 0.5 seconds and of the time for setting up the residual pressure more than 5.0 seconds sharply decreases the process efficiency. It is stipulated by the fact that the gases dissolved in the water should have the time to diffuse from it with a low speed and not affect the overcoming of the inertia of the rest water and the setting up of the regulated jet stream in the capillary tubes.

The sharp pressure release in the drying chamber may be achieved by the use of the vacuum chamber. A manifold of a definite diameter is used to connect the drying chamber with the vacuum chamber. The diameter of the connecting manifold is calculated by the following formula:

$$d = \sqrt[4]{\frac{(P + P_0)128\eta l V_0}{P \cdot P_0 t\pi}}$$

Wherein d—manifold diameter, m

P—pressure in the drying chamber, Pa

Po—pressure in the chamber, Pa

η—kinetic viscosity, c St l—manifold length, m

Vo—working free volume of the drying chamber t—time of reaching specified pressure in the drying chamber The volume of the vacuum chamber should be enough to provide the drying chamber with the pressure lower than the equilibrium water pressure in the capillary tubes in a short time for a given material at the residual pressure of 1 to 10 mm Hg in the vacuum chamber. When carrying out the process, the value of the residual pressure in the drying chamber has a great importance because it determines the value of the force that enables the water in the wood capillary tubes to overcome the inertia of the rest resistance against the surfaces of the capillary tubes. The degree of removing the moisture from the capillary tubes of the wood is intensified with the difference between the pressure set up by the vacuum chamber and the water pressure in the capillary tubes. The steps of firstly heating the wood loaded in the drying chamber under the atmosphere, and then under the residual equilibrium pressure up to a temperature of 80 to 100° C. in the pressure-tight drying chamber allow the volume of the vacuum chamber to be reduced to a fraction of its former size necessary for setting up the pressure of the drying chamber lower than the water vapor pressure in a short time.

A specified residual pressure of 1 to 10 mm Hg in the vacuum chamber is easily obtained to provide the drying chamber with a pressure of 5 to 15 mm Hg by using the existing industrial rotary vacuum pumps, thus effectively performing the drying process. A further reduction of the pressure in the vacuum chamber technically complicates the construction of the drying system while a further increase of the pressure degrades the efficiency.

The combined action of the steps of connecting the drying chamber with the vacuum chamber in 0.1 to 0.5 seconds, performing the pressure release from the drying chamber up to the residual pressure lower than the equilibrium pressure in 0.5–5.0 seconds, heating the wood in the vacuum with removal of the evolved vapors, heating it with the condensed water drained, holding it in the pressure-tight chamber under the residual vacuum, and heating it up to a temperature of 80 to 100° C. under the vacuum removes the free moisture from the wood basically by about 30%, thus facilitating the vacuum squeezing. As the water is displaced during vacuum blowing, the pressure inside the capillary tubes is maintained by partial vaporization in the capillary tubes. The heat consumption for the phase change decreases the temperature of the wood. It reduces the pressure in the capillary tubes, and thus the displacement of the water. The residual pressure drop equilibrates with the forces of the surface tension, stopping the displacement of the water from the capillary tubes. If the vacuum blowing is continued, the removal of the water will be carried out only through its evaporation. It fast cools off the wood so as to freeze the inside of it.

The removal of the free moisture from the wood capillary tubes is carried out basically without phase change from the liquid state. The greater part of it drained from the drying chamber through a vacuum-drain a is removed by vacuum, condensed in a collector. A part of the moisture especially in the bottom of the stack is sluiced. The moisture from the wood surface is transformed into the vaporous state, heated by a heat carrier with a temperature of 80 to 100° C. in a pressure-tight drying chamber at the residual pressure equal to the equilibrium of the water at a specified temperature. The extracted water vapor is removed from the drying chamber by fast connecting it with the vacuum chamber. The heat loss generated by the vaporization of the water is compensated for by blowing down the wood with a heat carrier of the volume average temperature of 80 to 100° C. The temperature of the heat carrier should be selected so that it does not destroy the wood surface layers due to overheating or degrade the efficiency of the warming-up due to inadequate heating. The time for warming up the wood is selected in the range of 30 to 120 minutes, since the temperature beyond the lower limit is insufficient for heating the wood to the required temperature while the temperature beyond the upper limit causes a great moisture difference between the surface and internal layers, developing stresses in the wood, and thus propagation of shakes.

Thus, the process, which comprises the steps of vacuum blowing, holding in the vacuum in the opened and closed state, continuous blasting of the with the heat carrier, and vacuum blowing under the equilibrium vapor pressure by connecting the drying chamber with the vacuum chamber having a pressure lower than the equilibrium, decreases the wood moisture up to 30%, only leaving the bound intracellular moisture therein. In order to remove the bound moisture to a desired level, the cycle of the drying process is repeated that comprises the steps of the vacuum blowing with simultaneous warming-up, holding in the pressure-tight chamber under the vapor equilibrium pressure for a time of 0.5 to 5.0 seconds, pressure release of the drying chamber up to the pressure lower than the equilibrium at a given temperature by connecting the drying chamber with the vacuum chamber under a pressure of 1 to 10 mm Hg. The vacuum blowing is carried out for 30 to 120 minutes with simultaneous heating by a heat carrier such as hot air with a temperature of 100 to 159° C. Then, the drying chamber is insulated from the vacuum blowing and held in that state for 30 to 60 minutes until the temperature of the wood gets 80 to 100° C. In this way, the cycle is repeated for achieving the required moisture level.

The result of the drying process was as follows:

When the bound water in the cells of the wood had a temperature of 80 to 100° C., and the pressure of the water vapors for a pine timber was 4759 to 10140 Pa or 35.7 to 76.2 mmHg by fast connecting the drying chamber with the vacuum chamber that has a volume corresponding to the free volume of the drying chamber or greater and a pressure of 1 to 10 mm Hg lower than the equilibrium pressure of the water vapor of the wood, sharp boiling up of the capillary moisture occurred through all the volume. The vapors from the pores of the wood evolved in the drying chamber were removed by the vacuum blowing. The subsequent holding of the wood in the vacuum provided even redistribution of the moisture in the wood, eliminating the surface and internal tensions causing the distortions and fracturing of the wood. Because the intensive phase change of the water results in a heat loss of the wood, the intensity of removing the bound moisture is degraded. In order to prevent this, an additional heating of the wood is performed in the vacuum blowing for 5 to 30 minutes. Also, an additional heating of the pressure-tight drying chamber for 5 to 30 minutes is optional. The time for holding the wood in the pressure-tight chamber less than 5 minutes cannot provide redistribution of the moisture throughout volume of the wood while the time more than 30 minutes causes the vapor pressure to reach the equilibrium, and thus, to stop the vapor removal.

The process may be realized on a system as shown in FIG. 1, which comprises two drying chambers 1, a heating apparatus provided in each of the drying chambers for evenly heating wood throughout its volume, a device for fast connecting each of the drying chambers with the vacuum blowing line in 0.1 to 5.0 seconds, shut-off accessories for connecting the two drying chambers with atmosphere, and pressure-tight charging device. It is necessary to use two drying chambers on order to increase performance coefficient of the accessories and to intensify the process. In case the material is heated in the first drying chamber, vacuum blowing is performed in the second drying chamber.

A first trapper 2 is designed for trapping resins and partially water. Reference numeral 3 represents a filter for trapping small wood particles. A pair of second trappers 4 are provided to trap and remove condensation of water vapors from the system through air-lock containers without loss of sealing of the vacuum blowing line. Reference numeral 5 represents a receiver for storing vacuum required for carrying out high-speed vacuum blowing in 0.1–5.0 seconds. Vacuum pumps 6 are provided to set up working pressure in the receiver. In addition, a collector 7 is provided to collect a free moisture example pressed out.

Pine boards each 6000 mm in length, 150 mm in width, and 50 mm in depth are dried. While the initial moisture was detected as 70%, the final moisture after processing has been detected as 8%. The boards are stacked to form a plurality of layers on a cart with an interlayer of battens each having a size of 25×25×1400 mm between the adjacent board layers. As a result, a stack of boards 1400×1400×6000 mm is by rail into the drying chamber, equipped with a hot air supply system for evenly heating the timbers.

The drying chamber is hermetically closed, heated by hot air with the temperature of 140° C. A vacuum pump is used to produce the pressure of 5 to 10 mm Hg in the receiver. When the timbers are heated up to 90° C. (75 min), a quick-action valve connecting the drying chamber with vacuum is switched on to perform vacuum blowing for 100 minutes, then the drying chamber is insulated from vacuum blowing and held under residual air for 60 minutes. In this case, the heating is not switch off, and the wood temperature again raises up to 90° C. These operations are repeated until the temperature of the material is decreased by the sharp vacuum blowing. At removal of the free moisture, the wood temperature remains constant, not less than 30° C. When removal of the free moisture from wood is completed, it is drained into the collector 7 without loss of sealing of the drying chamber. The sequence of subjecting the material to the high-speed vacuum blowing with heating, and holding it in the vacuum with heating constitutes one drying cycle.

For example, after preheating the material for 75 minutes, it is subjected to the high-speed vacuum blowing with simultaneous heating for 100 minutes, then to heating under the residual vacuum up to the equilibrium pressure for 60 minutes. Such drying cycle, which consists of the high-speed vacuum blowing with simultaneous heating for 100 minutes, and heating under the residual vacuum up to the equilibrium pressure for 60 minutes, is repeated three times. Hence, the time taken for such process including the preheating totals 555 minutes.

Figure 2:
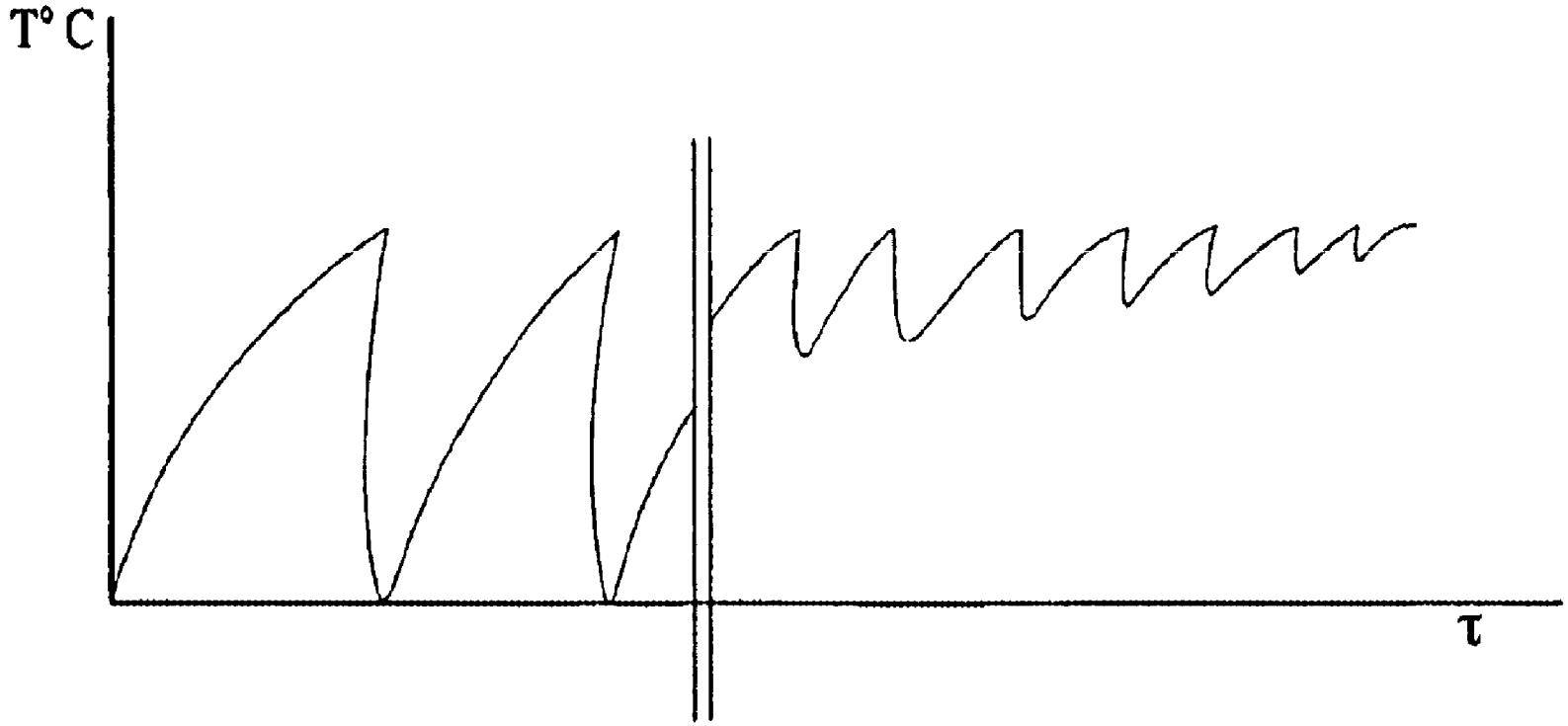
FIG. 2 is a graph for illustrating the change of moisture content in a timber processed under varying temperature and pressure according to the present invention.

The beginning of removal of bound moisture is determined by sharp decrease of the temperature of the material in the process of high-speed vacuum blowing, which temperature does not exceed 20° C. Increasing the number of cycles, it decreases to zero. It results in decreasing the time of the high-speed vacuum blowing up to 15 minutes. The pressure-tight chamber is heated for 20 min. The number of cycles necessary to remove bound moisture is 8. Namely, in order to remove the bound moisture, the material is subjected to the high-speed vacuum blowing with simultaneous heating for 15 minutes, and then to heating under the residual vacuum up to the equilibrium pressure for 20 minutes. Hence, the time taken for 8 cycles of such process totals 280 minutes. The amount of the removed free moisture for one cycle is about 20%. The amount of the removed bound moisture for one cycle is about 3.7%. The experimental test showed that increase or decrease of free moisture influences on only one time of the first stage of drying, time of the second stage remains constant. The thermogram of drying wood according to the invention is shown in FIG. 2. The method has passed the industrial testing in the conditions of furniture factory, with output 300 $m^3$/month.

While the present invention has been described specifically in connection with the attached drawings, it will be readily appreciated by those skilled in the art that various changes and modifications may be made to the specific embodiment without departing the gist of the invention.

What is claimed is:

1. A method of drying timbers loaded in a drying chamber comprising:

heating said drying chamber by a heating system up to temperature of 80 to 100° C.;

subjecting said timbers to vacuum blowing by connecting the inside of said drying chamber with a vacuum chamber (receiver) evacuated by a rotary pump;

disconnecting the inside of said drying chamber from said vacuum chamber;

holding said timbers in said drying chamber closed in pressure-tight until the pressure of said chamber reaches the equilibrium pressure of the vapor evolved in said drying chamber at a given temperature; and repeating the previous steps.

2. A method of drying timbers as defined in claim 1, wherein the heating is continued during holding said timbers in the pressure-tight drying chamber in the vacuum.

3. A method of drying timbers as defined in claim 1, wherein the heating of said timbers is carried out up to the volume average temperature of 80 to 100° C.

4. A method of drying timbers as defined in claim 1, wherein the process of vacuum blowing is carried out until the pressure in the vacuum chamber reaches 1 to 10 mm Hg.

5. A method of drying timbers as defined in claim 1, wherein the connection of the drying chamber with the vacuum chamber is carried out in a time of 0.1 to 0.5 seconds.

6. A method of drying timbers as defined in claim 1, wherein the release of the pressure in the drying chamber is carried out in a time of 0.5 to 5.0 seconds.

7. A method of drying timbers as defined in claim 6, wherein the diameter of a manifold for connecting said drying chamber with said vacuum chamber is calculated by the following formula:

$$d = \sqrt[4]{\frac{(P + P_0)128\eta l V_0}{P \cdot P_0 t\pi}}$$

Wherein d—manifold diameter, m p—pressure in the drying chamber, Pa

Po—pressure in the receiver, Pa

η—kinetic viscosity, c St.

l—manifold length from the drying chamber to the receiver, m.

Vo—working free volume of the drying chamber, m3 t—time of reaching specified pressure in the drying chamber, s.

8. A method of drying timbers as defined in claim 4, wherein the volume of said vacuum chamber is selected so as to provide the drying chamber with a pressure less than the equilibrium vapor pressure at a given temperature.

9. A method of drying timbers as defined in claim 5, wherein the volume of said vacuum chamber is selected so as to provide the drying chamber with a pressure less than the equilibrium vapor pressure at a given temperature.

10. A method of drying timbers as defined in claim 6, wherein the volume of said vacuum chamber is selected so as to provide the drying chamber with a pressure less than the equilibrium vapor pressure at a given temperature.

11. A method of drying timbers as defined in claim 7, wherein the volume of said vacuum chamber is selected so as to provide the drying chamber with a pressure less than the equilibrium vapor pressure at a given temperature.

12. A system of drying timbers loaded in a drying chamber comprising a heating system for heating said drying chamber up to a temperature of 80 to 100° C., a vacuum chamber connected with the inside of said drying chamber for subjecting said timbers to vacuum blowing, a vacuum pump connected with said vacuum chamber, a manifold for connecting said drying chamber with said vacuum pump, a condenser connected with said vacuum chamber for draining the condensate therein, a first automatic quick-action valve for connecting said drying chamber with the atmosphere, and a second automatic quick-action valve for connecting said condenser with said vacuum chamber.

13. A system as defined in claim 12, wherein said heating system is designed so as to blow a hot air tangentially (vertically) to said timbers.

14. A system as defined in claim 12, wherein said drying chamber is divided into a plurality of zones each having a quick reacting vacuum valve to said heating system.

15. A system as defined in claim 12, wherein the inside of said drying chamber is equipped with a plurality of elements for equivalently supplying said hot air along the height of said timbers.

16. A system as defined in claim 13, wherein said drying chamber is divided into a plurality of zones each having a quick reacting vacuum valve to said heating system.

17. A system as defined in claim 13, wherein the inside of said drying chamber is equipped with a plurality of elements for equivalently supplying said hot air along the height of said timbers.

18. A system as defined in claim 14, wherein the inside of said drying chamber is equipped with a plurality of elements for equivalently supplying said hot air along the height of said timbers.

19. A system as defined in claim 16, wherein the inside of said drying chamber is equipped with a plurality of elements for equivalently supplying said hot air along the height of said timbers.

* * * * *